US009023777B1

(12) United States Patent
Broten

(10) Patent No.: US 9,023,777 B1
(45) Date of Patent: May 5, 2015

(54) SEGMENTED SOAP BAR WITH SOAP BODIES FORMING CONCAVE ARC SURFACE

(71) Applicant: Neil E. Broten, Woodinville, WA (US)

(72) Inventor: Neil E. Broten, Woodinville, WA (US)

( * ) Notice: Subject to any disclaimer, the term of this patent is extended or adjusted under 35 U.S.C. 154(b) by 20 days.

(21) Appl. No.: 13/939,455

(22) Filed: Jul. 11, 2013

(51) Int. Cl.
*C11D 17/00* (2006.01)
*C11D 17/04* (2006.01)

(52) U.S. Cl.
CPC ..... *C11D 17/048* (2013.01)

(58) Field of Classification Search
CPC ..... C11D 17/0048
See application file for complete search history.

(56) References Cited

U.S. PATENT DOCUMENTS 2,420,734 A * 5/1947 Churchill ..... 510/143

* cited by examiner

*Primary Examiner* — Necholus Ogden, Jr.

(57) ABSTRACT

An elongated segmented soap bar is segmented longitudinally into a plurality of soap bodies separate and discrete from one another. Adjacent soap bodies are movable with respect to one another between at least two different configurations including at least an arc configuration with the plurality of soap bodies disposed in an arc. At least one coupler couples the plurality of soap bodies together to allow the adjacent soap bodies to move with respect to one another between the at least two different configurations.

17 Claims, 9 Drawing Sheets

SEGMENTED SOAP BAR WITH SOAP BODIES FORMING CONCAVE ARC SURFACE

BACKGROUND

1. Field of the Invention

The present invention relates generally to soap or a bar of soap for personal washing or cleansing.

2. Related Art

Soap bars are available for use in personal washing or bathing in a shower or bathtub. Such soap bars are often provided in rectangular shapes, and often with flat or protruding (convex) surfaces. When such convex surfaces of the soap are rubbed over the convex surfaces of the body, the result can be reduced surface area contact and less efficient washing.

SUMMARY OF THE INVENTION

It has been recognized that it would be advantageous to develop a soap bar to increase the useable surface area of the soap. In addition, it has been recognized that it would be advantageous to develop a soap bar to increase the amount of surface area of the soap against the body. Furthermore, it has been recognized that it would be advantageous to develop a soap bar to increase the efficiency and/or ease of washing.

The invention provides a soap bar for personal cleansing with an elongated segmented soap bar segmented longitudinally into a plurality of soap bodies separate and discrete from one another. Adjacent soap bodies are movable with respect to one another between at least two different configurations including at least an arc configuration with the plurality of soap bodies disposed in an arc. At least one coupler couples the plurality of soap bodies together to allow the adjacent soap bodies to move with respect to one another between the at least two different configurations.

In addition, the invention provides a soap bar for personal body cleansing with a plurality of solid soap bodies spaced-apart in an array. A plurality of gaps are each disposed between a different pair of adjacent soap bodies of the plurality of soap bodies to form a series of alternating soap bodies and gaps. A plurality of hinges is each pivotally coupling a different pair of adjacent soap bodies. The adjacent soap bodies are pivotal with respect to one another about a respective hinge with the plurality of soap bodies being pivotal between a plurality of different configurations including: an arc configuration with the plurality of soap bodies disposed in an arc, and a straight configuration with the plurality of soap bodies disposed in a straight line. Each of the plurality of hinges comprises embedded portions embedded in adjacent soap bodies, and an exposed portion between the embedded portions and exposed with respect to the adjacent soap bodies.

Furthermore, the invention provides a soap bar for personal body cleansing with a plurality of solid soap bodies spaced-apart in an array. A plurality of gaps is each disposed between a different pair of adjacent soap bodies of the plurality of soap bodies to form a series of alternating soap bodies and gaps. The plurality of soap bodies is spaced-apart less than a width of one of the plurality of soap bodies. A width of the plurality of gaps between the plurality of soap bodies less than the width of one of the plurality of soap bodies. Each of the plurality of soap bodies has a transverse length perpendicular to a longitude of the soap bar and greater than a longitudinal width of each of the plurality of soap bodies parallel to the longitude of the soap bar. An elongated flexible pad extends through the plurality of soap bodies and through the plurality of gaps. The pad forms a plurality of hinges, each pivotally coupling a different pair of adjacent soap bodies. The adjacent soap bodies are pivotal with respect to one another about a respective hinge, with the plurality of soap bodies being pivotal between a plurality of different configurations including: an arc configuration with the plurality of soap bodies disposed in an arc, and a straight configuration with the plurality of soap bodies disposed in a straight line. The pad has embedded segments embedded in the plurality of soap bodies, and exposed segments between adjacent soap bodies in the gaps. The embedded segments comprise protrusions extending into a respective soap body, or indentations recessed into the pad with the respective soap body extending therein, or both. The plurality of hinges has a transverse length perpendicular to the longitude of the soap device greater than the longitudinal width of adjacent soap bodies. Each of the plurality of soap bodies is separated only and solely from an adjacent soap body by a gap. Each of the plurality of soap bodies comprises lateral sides that taper from a wider inner portion adjacent the pad to a narrower outer surface. The outer surfaces of the plurality of soap bodies together form a concave arc surface in the arc configuration. The soap bodies are spaced-apart in the straight configuration, and adjacent soap bodies abut to one another in the arc configuration.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
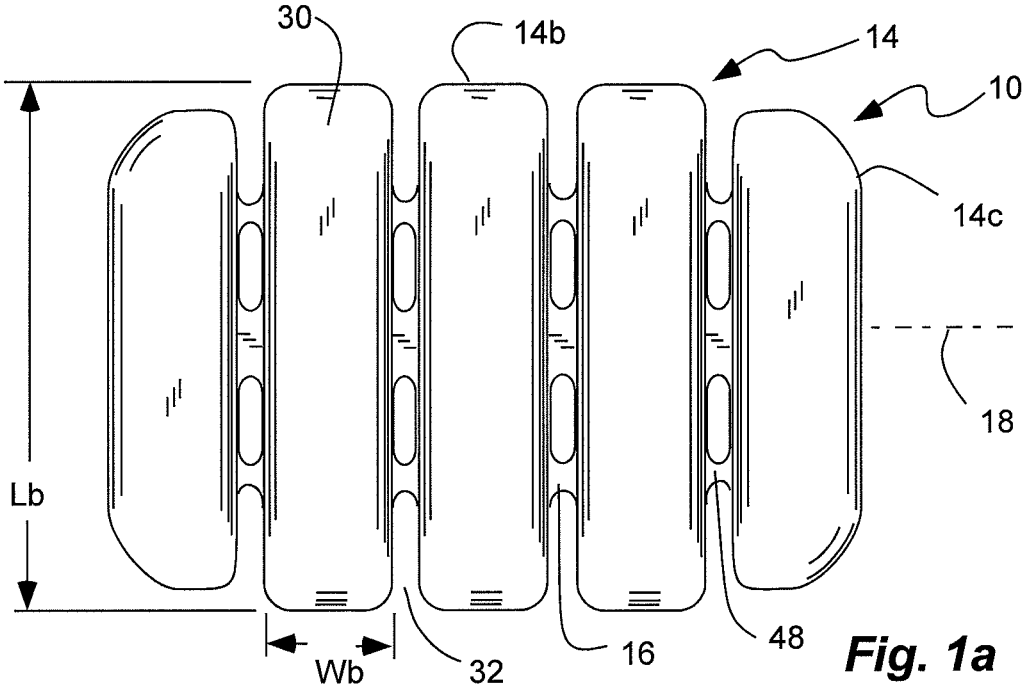
FIG. 1*a* is a top view of a soap bar in accordance with an embodiment of the present invention with a plurality of soap bodies.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The term "soap" is used herein to refer to a cleansing agent used with water for washing and cleansing, and that is in a solid form and dissolvable over time in water and with use. Such soap can be formed in bars or cakes. The soap can be formed from a mixture of the sodium salts of various fatty acids of natural oils and fats. The soap can react with the minerals common in most water, forming an insoluble film.

Description

As illustrated in FIGS. 1*a*-5, a soap bar or device, indicated generally at 10, in an example implementation in accordance with the invention is shown for personal cleansing or washing, or washing a user's body, torso and limbs. The soap bar is segmented to have a plurality of soap bodies that are movable with respect to one another to form an arc with a concave indentation with a concave arc surface to more closely match the concave curvature of a user's body (such as torso and limbs), and to increase the surface area of the soap bar against the user's skin. The soap bodies can be movably coupled together and can be moved or pivoted into an arc configuration to form or create a substantially continuous arcuate concave surface. Thus, the user's or bather can have a greater surface area of soap to rub against his or her skin, which can increase washing efficiency. In addition, the soap bodies can move or pivot with respect to one another to match various different curvatures of the user's body, torso and limbs. Furthermore, the soap bodies can change the arc or radius thereof dynamically as the soap body is moved across different curvatures of the user's skin.

The soap bar 10 or device can be an elongated segmented soap bar that is segmented longitudinally into a plurality of individual soap bodies 14 that are separate and discrete from one another. The soap bodies 14 can be spaced-apart from one another in an array to form a series of alternating soap bodies and gaps. The soap bodies can be coupled together by at least one coupler 16 coupling the soap bodies 14 together to allow adjacent soap bodies to move with respect to one another. The coupler 16 can be an elongated flexible pad extending through the soap bodies 14 and through gaps between the soap bodies.

The soap bodies 14 can be solid, or formed of solid soap. The soap bodies 14 can comprise interior soap bodies 14*b* that have adjacent soap bodies on both sides, and exterior or end soap bodies 14*c* that are disposed at the ends of the bar and have only a single adjacent soap body. In one aspect, the interior soap bodies 14*b* can be substantially identical, with substantially similar size and shape, while the end soap bodies 14*c* can have a different size and/or shape than the interior soap bodies so that the soap bodies 14 together form an overall shape and/or size of the soap bar, as shown. For example, the end soap bodies 14*c* can be smaller and/or have distal ends with a greater taper or radius to provide an overall shape of the soap bar that facilitates grasping (such as an enlarged center and reduced ends to fit in a user's palm), as shown. In another aspect, all of the soap bodies 14 can be substantially the same (see FIGS. 13-15) to facilitate manufacture or increase available surface area.

The soap bodies 14 can have a transverse length Lb perpendicular to a longitude (or longitudinal axis 18) of the soap bar, and a longitudinal width Wb parallel to the longitude (or longitudinal axis 18) of the soap bar. The length L of the soap bodies can be greater than the width W of the soap bodies to provide a wide soap bar that moves or pivots about an axis perpendicular to the longitudinal axis to increase surface area of the soap against the user's skin. In addition, the coupler 16 between adjacent soap bodies, or the portion thereof between adjacent soap bodies, can have a transverse length Lc perpendicular to the longitude (or longitudinal axis 18) of the soap bar and a width Wc parallel to the longitude (or longitudinal axis 18) of the soap bar. The length Lc can be greater than the width Wb of adjacent soap bodies, or width Wc of the connector therebetween, to resist or limit twisting of the soap bodies about the longitudinal axis or with respect to one another.

In addition, the soap bodies 14 can have lateral sides 22 that taper from a wider inner portion 26 adjacent the coupler 16 to a narrower outer surface 30 to facilitate moving or pivoting with respect to one another. In addition, the soap bodies 14 can be spaced-apart less than the width Wb of the soap bodies 14 by a plurality of gaps 32. Each of the plurality of gaps can be disposed between a different pair of adjacent soap bodies to form a series of alternating bodies and gaps. In one aspect, the gaps can be annular and circumscribes the coupler. A width (Wc) of the gaps 32 between the soap bodies can be less than the width Wb of the soap bodies to limit or restrict the degree of movement or pivoting between the adjacent soap bodies. Furthermore, the soap bodies 14 can be separated only and solely from an adjacent soap body by the gap 32, without intervening objects. Thus, the soap bodies can dissolve during use to provide a substantially even outer surface without intervening objects.

Figure 2A:
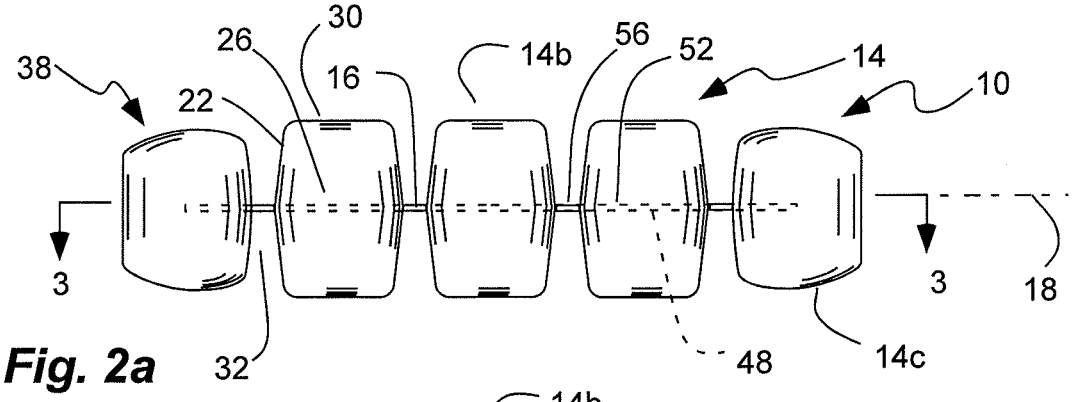
FIG. 2*a* is a side view of the soap bar of FIG. 1*a*, shown in a straight configuration with the plurality of soap bodies disposed in a straight configuration.
Figure 2B:
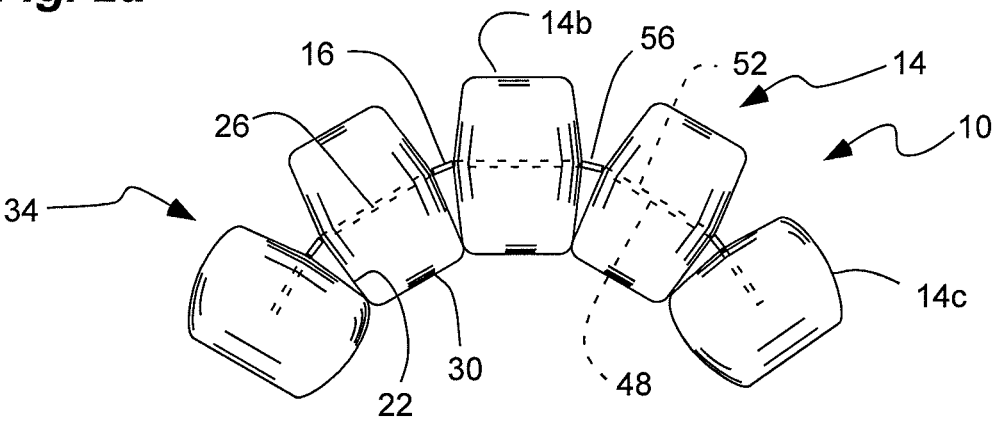
FIG. 2*b* is a side view of the soap bar of FIG. 1*a*, shown in an arc configuration with the plurality of soap bodies disposed in an arc.

The adjacent soap bodies 14 can movable and/or pivotal with respect to one another between at least two different configurations, including: at least an arc configuration, indicated by 34 in FIG. 2*b*; and a straight configuration, indicated by 38 in FIG. 2*a*. In the arc configuration 34, the soap bodies 14 can be disposed in an arc, and the outer surfaces 30 of the soap bodies together form a concave arc surface. The soap bodies 14 can have multiple different arc configurations with different arc shapes and/or different arc surfaces with different radii. In the straight configuration 38, the plurality of soap bodies can be disposed in a substantially straight line. The soap bodies 14 can be spaced-apart in a linear orientation in the straight configurations, and the soap bodies 14 can abut to one another in the arc configuration.

In one aspect, the coupler 16 can be flexible and resilient or elastic so that it is flexible enough to allow the soap bodies 14 to move or pivot with respect to one another into the arc configuration 34, but resilient enough to return itself and the soap bodies 14 to the straight configuration 38. Thus, the user can apply force to the soap body or bodies to obtain the arc configuration 34. Maintaining the soap bodies in the straight configuration, or resisting the arc configuration, can facilitate drying after use, and/or facilitate griping the soap bar by pushing the soap bodies back into the user's palm. In another aspect, the coupler 16 can be flexible without resisting either configuration. In another aspect, the coupler 16 can have shape memory to remain in the configuration imposed upon it. For example, the coupler can include a wire.

Figure 6:
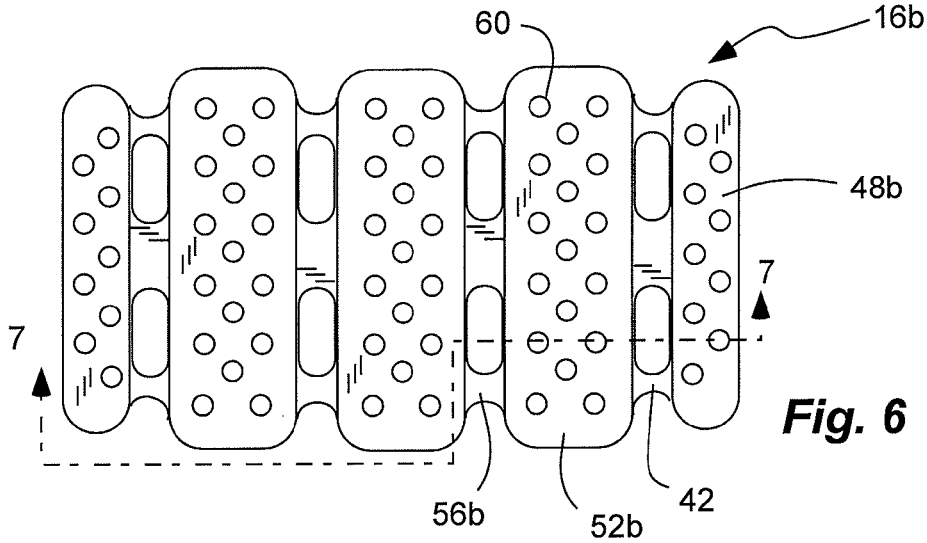
FIG. 6 is a top view of another coupler of another soap bar in accordance with another embodiment of the present invention.
Figure 7:
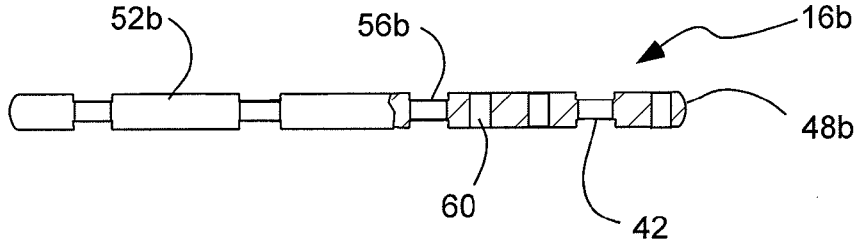
FIG. 7 is a partial cross-sectional side view of the coupler of FIG. 6, taken along line 7 of FIG. 6.

The coupler 16 can form a hinged connection between the adjacent soap bodies 14 to allow the adjacent soap bodies 14 to pivot with respect to one another. The coupler can form or can include a plurality of hinges, each pivotally coupling a different pair of adjacent soap bodies. The adjacent soap bodies can be pivotal with respect to one another about a respective hinge. In one aspect, the coupler and/or the hinged connection can be a solid material forming a living hinge. For example, the coupler or hinged connection can be or can comprise plastic that is flexible to bend between the adjacent soap bodies. In addition, the living hinge and/or the hinged connection of the coupler 16*b* can have a reduced cross-sectional area 42 with respect to an embedded segment to form the living hinge, as shown in FIGS. 6 and 7.

Figure 1B:
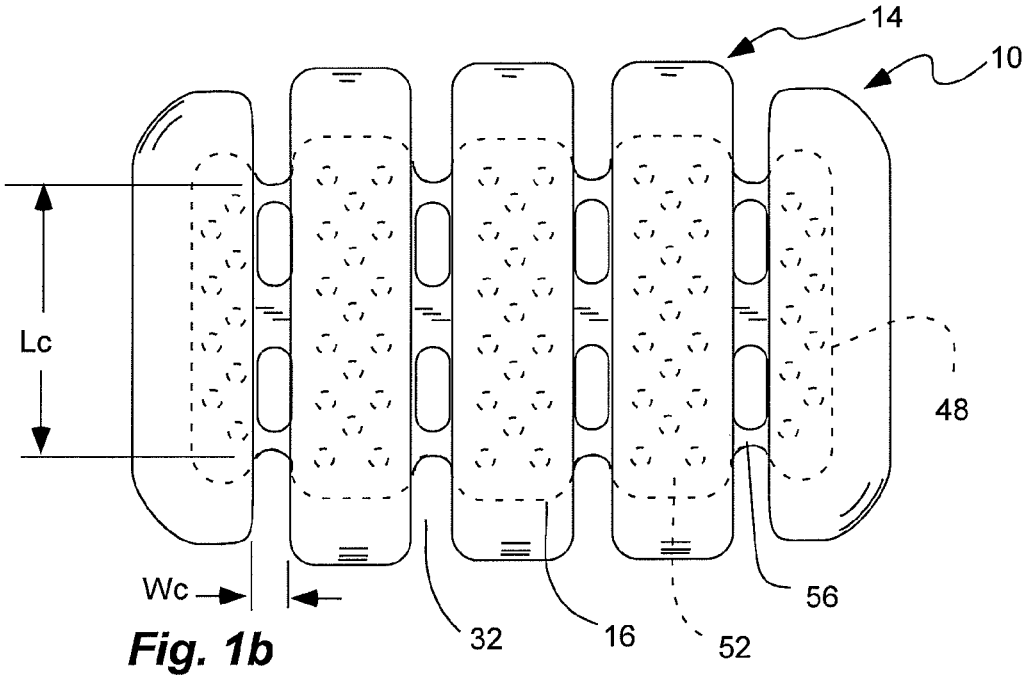
FIG. 1*b* is a top view of the soap bar of FIG. 1*a*, and showing a coupler coupling the plurality of soap bodies together.
Figure 3:
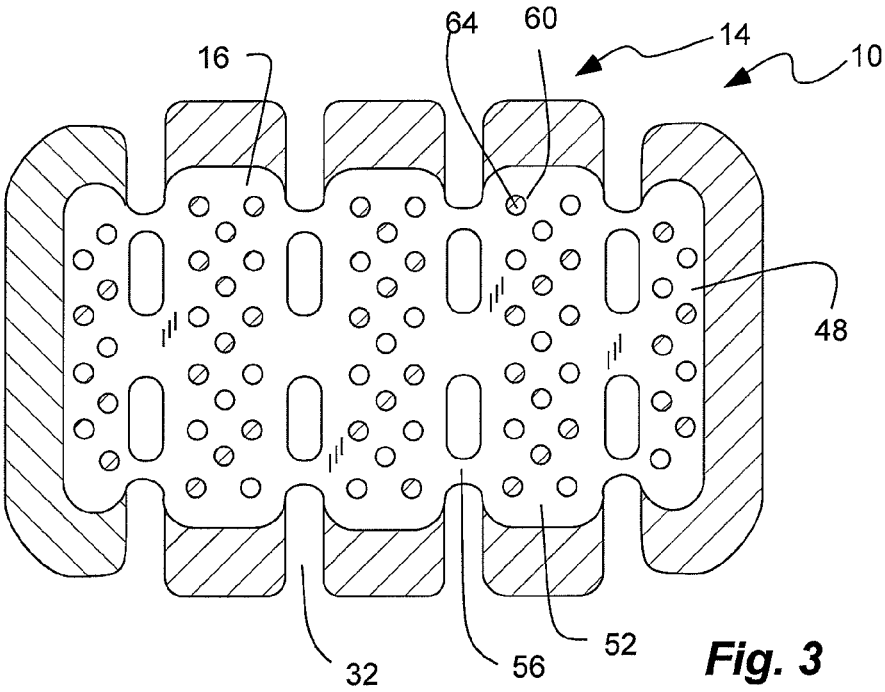
FIG. 3 is a cross-sectional top view of the soap bar of FIG. 1*a*, taken along line 3 of FIG. 2*a* and showing the coupler coupling the plurality of soap bodies together.
Figure 4:
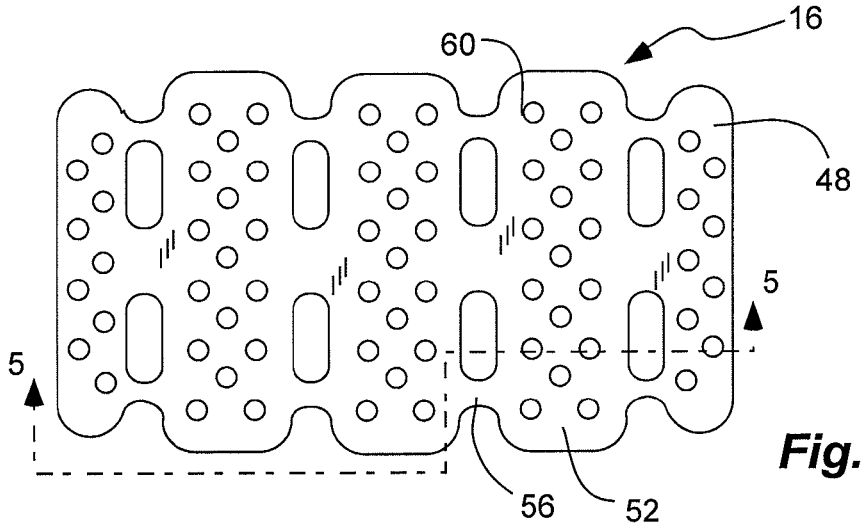
FIG. 4 is a top view of the coupler of the soap bar of FIG. 1*a;*
Figure 5:
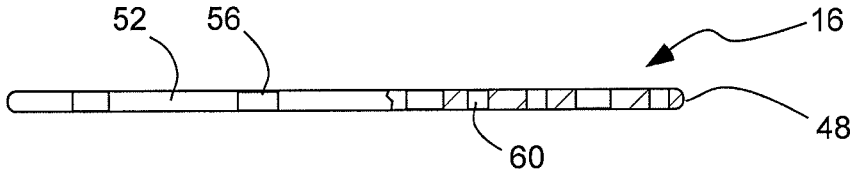
FIG. 5 is a partial cross-sectional side view of the coupler of FIG. 4, taken along line 5 of FIG. 4.
Figure 8:
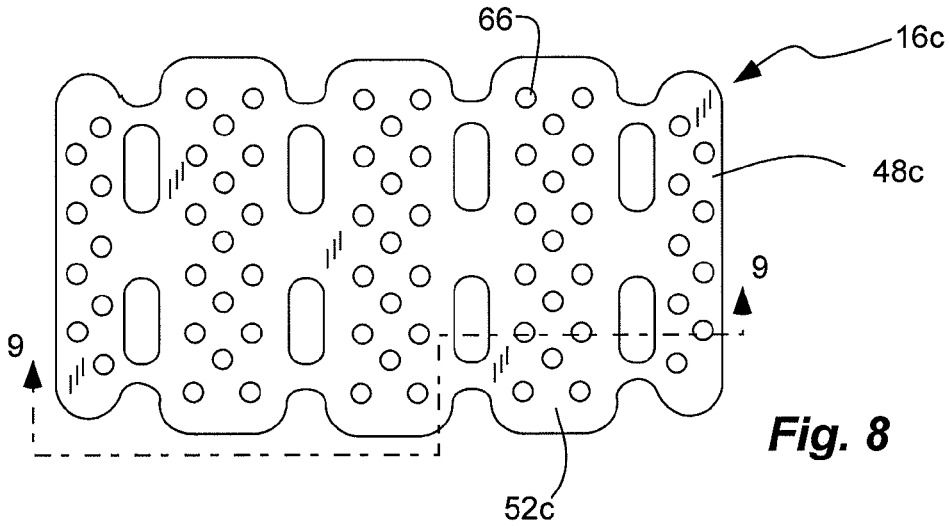
FIG. 8 is a top view of another coupler of another soap bar in accordance with another embodiment of the present invention.
Figure 9:
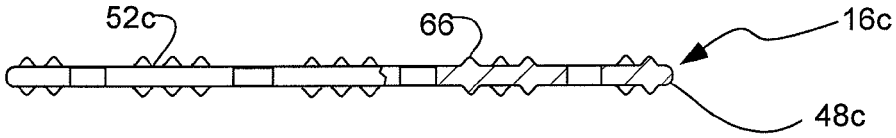
FIG. 9 is a partial cross-sectional side view of the coupler of FIG. 8, taken along line 9 of FIG. 8.

As mentioned above, the coupler 16, and the hinged connection, can comprise an elongated flexible pad 48 extending through the soap bodies 14 and through the gaps 32 between the soap bodies. The coupler 16 and/or the pad 48 can be single, unitary, continuous and monolithic. The soap bar 10 can be formed by pouring or molding the soap bodies 14 around the pad 48. The pad 48 can have embedded segments 52 embedded in the soap bodies 14, and exposed segments 56 (coupler 16 between adjacent soap bodies, or the portion thereof between adjacent soap bodies) between adjacent soap bodies in the gaps 32, as shown in FIGS. 1*b* and 3. In one aspect, the embedded segments 52 can comprise indentations 60 recessed into the pad (such as holes) with the respective body portions 64 extending therein to assist in retaining the relative position of the soap bodies and pad, and maintaining the soap bodies on the pad, as shown in FIGS. 1*b* and 3-5. The indentations can be holes that extend through the pad. In another aspect, the embedded segments 52*c* of the pad 48*c* and/or coupler 16*c* can comprise protrusions 66 extending into a respective soap body, as shown in FIGS. 8 and 9. In another aspect, the embedded segments of the pad can comprise both indentations and protrusions.

The coupler 16 and/or pad 48 can have openings therethrough in the exposed segments 56 to facilitate the passage of water.

The soap bar 10 described above can provide an outermost arcuate surface formed by the outer surface 30 of the soap bodies 14 that move and/or pivot to form an arc. Thus, the usable surface area of the soap bar is increased with respect to a flat surface, and more closely matches the convex curvature of a user's body, torso and limbs. In addition, the curvature or arcuate outermost surface of the soap bar can change dynamically as moved across the user's skin to adapt to the different convex curvatures encountered as it moves across the user's skin. Thus, the efficiency and/or effectiveness of the cleaning process to be increased and bathing time reduced. The tapered sides 22 of the soap bodies 14 allow the soap bodies to pivot and/or move towards one another to form the arcuate outermost surface.

Referring to FIGS. 6 and 7, another coupler 16*b* and/or pad 48*b* is shown that is similar in many respects to that described above, and which description is incorporated herein by reference. The coupler 16*b* can have embedded segments 52*b* that are thicker than exposed segments 56*b* in the gaps between the soap bodies 14. The reduced thickness of the exposed segments 56*b* of the coupler 16*b* and/or pad 48*b* can facilitate bending, and can form a living hinge and/or a hinged connection between the soap bodies.

Referring to FIGS. 8 and 9, another coupler 16*c* and/or pad 48*c* is shown that is similar in many respects to those described above, and which description is incorporated herein by reference. The coupler 16*c* and/or pad 48*c* can have embedded segments 52*c* with protrusions 66 extending into the soap bodies to maintain the soap bodies 14 on the pad 48*c*.

Figure 10:
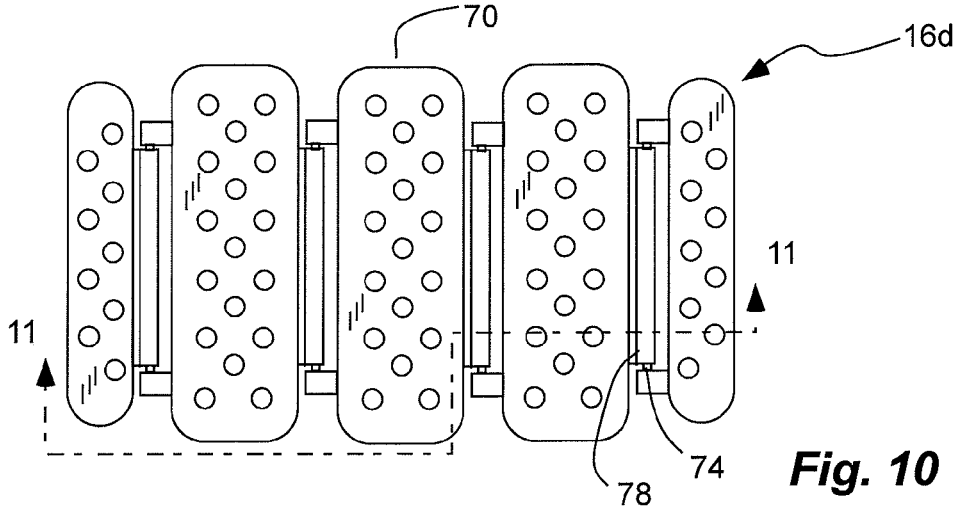
FIG. 10 is a top view of another coupler of another soap bar in accordance with another embodiment of the present invention.
Figure 11:
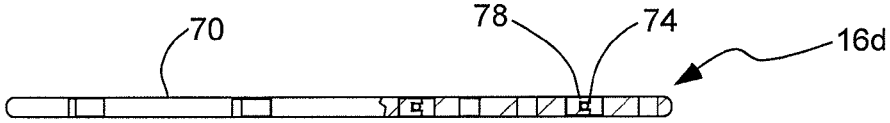
FIG. 11 is a partial cross-sectional side view of the coupler of FIG. 10, taken along line 11 of FIG. 10.

Referring to FIGS. 10 and 11, another coupler 16*d* is shown that is similar in many respects to those described above, and which description is incorporated herein by reference. The coupler 16*d* can include links 70 that can be pivotally and removably coupled together. The links can each have a central or intermediate embedded segment, and opposite distal ends that are exposed segments. One of the distal ends can be an axle 74 and the opposite end can be a recess 78. The axel of one link can be removably or snap-fit into the recess of an adjacent link. In addition, the axle can pivot in the receptacle forming a hinge. Thus, the length of the soap bar can be increased or decreased by adding or removing, respectively, the links with soap bodies thereon.

Figure 12A:
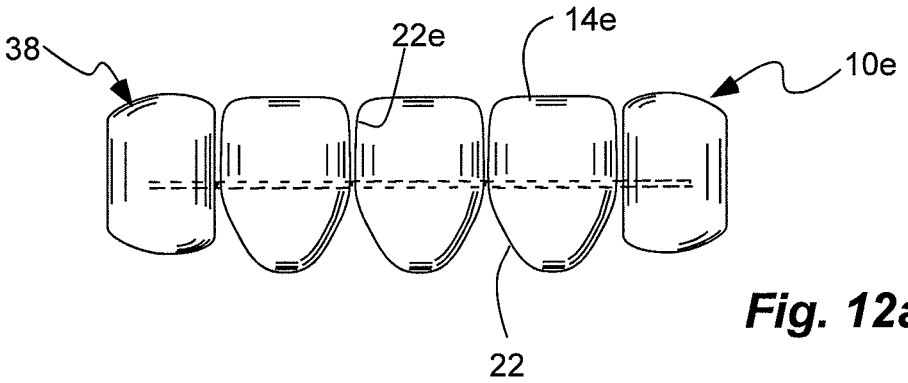
FIG. 12*a* is a side view of another soap bar in accordance with another embodiment of the present invention shown in a straight configuration with the plurality of soap bodies disposed in a straight line.
Figure 12B:
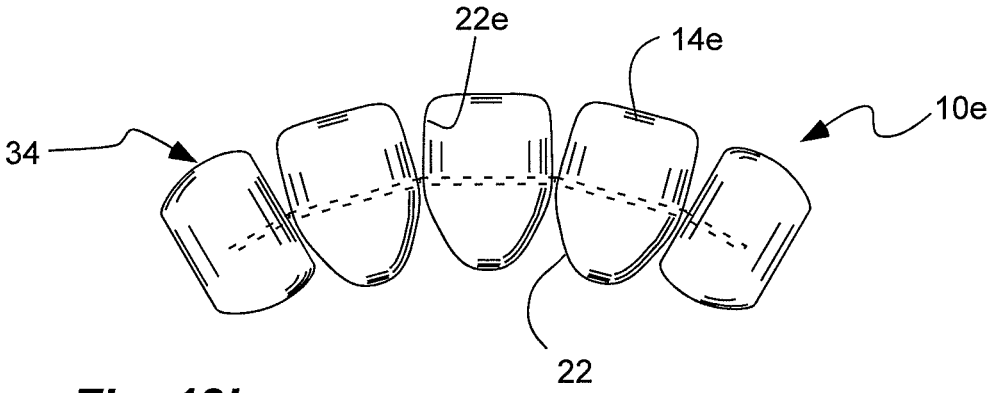
FIG. 12*b* is a side view of the soap bar of FIG. 12*a*, shown in an arc configuration with the plurality of soap bodies disposed in an arc.

Referring to FIGS. 12*a* and 12*b*, another soap bar 10*e* is shown that is similar in many respects to those described above, and which description is incorporated herein by reference. The soap bodies 14*e* can have sides 22 with a taper on only one side of the pad or coupler so that the soap bar can pivot in only a single direction (as opposed to that shown in FIGS. 1*a*, 2*a* and 2*b* that can pivot in opposite directions). The soap bodies 14*e* can have parallel sides 22*e* that abut to one another opposite the tapering sides 22.

Figure 13:
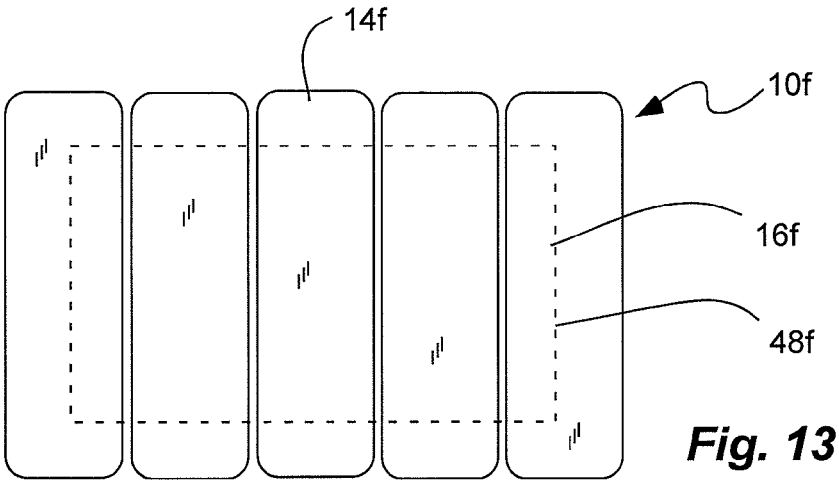
FIG. 13 is a top view of another soap bar in accordance with another embodiment of the present invention.

Referring to FIG. 13, another soap bar 10*f* is shown that is similar in many respects to those described above, and which description is incorporated herein by reference. The soap body can have a single coupler 16*f* and/or pad 48*f*. In addition, all of the soap bodies 14*f* can have a similar shape and/or size.

Figure 14:
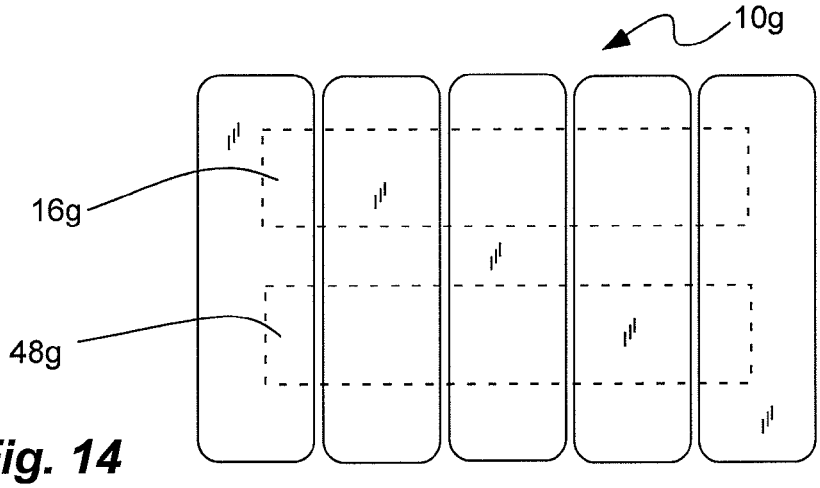
FIG. 14 is a top view of another soap bar in accordance with another embodiment of the present invention.

Referring to FIG. 14, another soap bar 10*g* is shown that is similar in many respects to those described above, and which description is incorporated herein by reference. The soap body can have multiple couplers 16*g* and/or pads 48*g* extending between the soap bodies and the gaps in parallel to provide openings therebetween for the passage of water.

Figure 15:
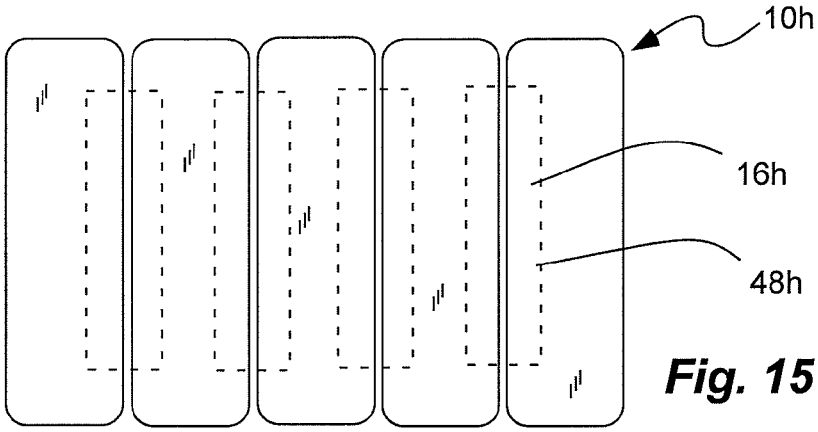
FIG. 15 is a top view of another soap bar in accordance with another embodiment of the present invention.

Referring to FIG. 15, another soap bar 10*h* is shown that is similar in many respects to those described above, and which description is incorporated herein by reference. The soap body can have multiple couplers 16*h* and/or pads 48*h*, with each one extending only between a pair of adjacent soap bodies to reduce the material of the coupler, and increase the amount of soap.

Figure 16A:
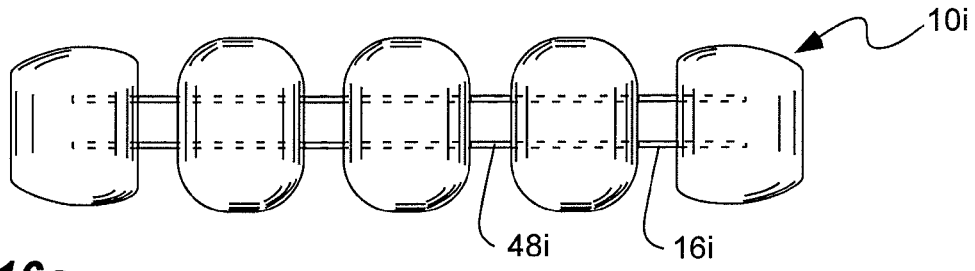
FIG. 16*a* is a side view of another soap bar in accordance with another embodiment of the present invention shown in a straight configuration with the plurality of soap bodies disposed in a straight line.
Figure 16B:
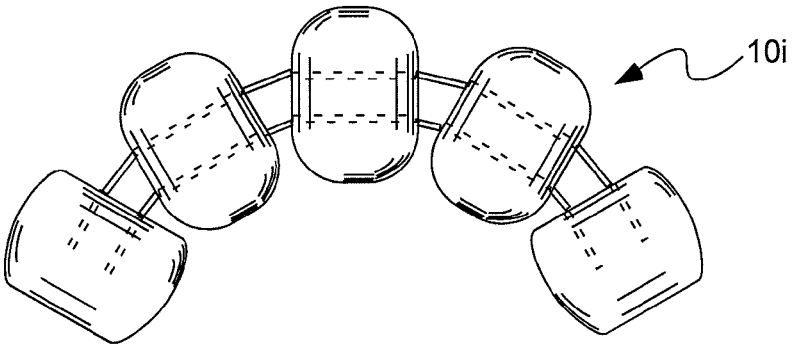
FIG. 16*b* is a side view of the soap bar of FIG. 16*a*, shown in an arc configuration with the plurality of soap bodies disposed in an arc.

Referring to FIGS. 16*a* and 16*b*, another soap bar 10*i* is shown that is similar in many respects to those described above, and which description is incorporated herein by reference. The soap body can have multiple couplers 16*i* and/or pads 48*i* extending between the soap bodies in multiple layers, which can provide additional resistance to bending, and can return the soap bodies to their straight configuration. In addition, the couplers 16*i* and/or pads 48*i* can be elastic and can stretch to facilitate pivoting of the soap bodies.

Figure 17A:
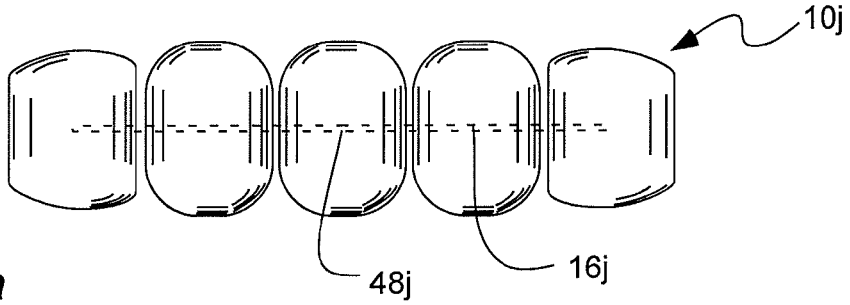
FIG. 17*a* is a side view of another soap bar in accordance with another embodiment of the present invention shown in a straight configuration with the plurality of soap bodies disposed in a straight line.
Figure 17B:
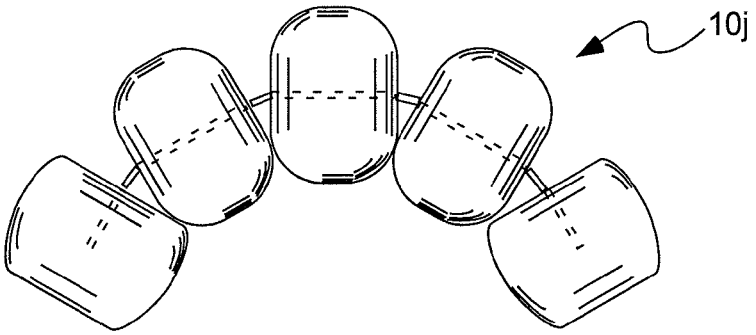
FIG. 17*b* is a side view of the soap bar of FIG. 17*a*, shown in an arc configuration with the plurality of soap bodies disposed in an arc.

Referring to FIGS. 17*a* and 17*b*, another soap bar 10*j* is shown that is similar in many respects to those described above, and which description is incorporated herein by reference. The soap bodies 14 can be disposed immediately adjacent one another so that adjacent soap bodies abut to one another to limit or control the flow of water through the soap bar. In addition, the coupler 16*j* and/or pad 48*j* can be elastic and can stretch to facilitate pivoting of the soap bodies.

Figure 18A:
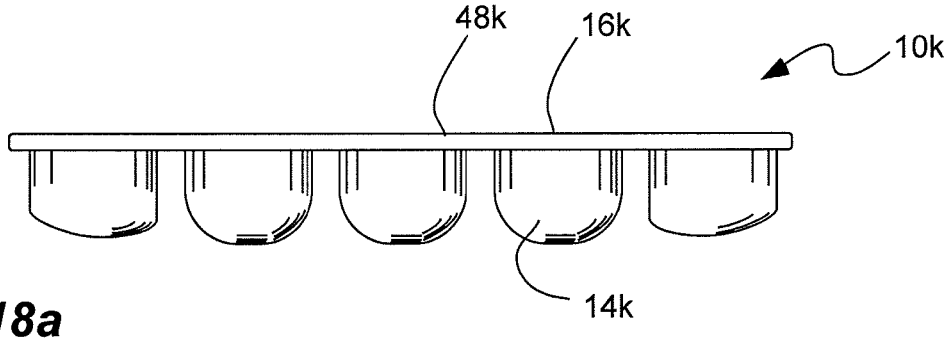
FIG. 18*a* is a side view of another soap bar in accordance with another embodiment of the present invention shown in a straight configuration with the plurality of soap bodies disposed in a straight line.
Figure 18B:
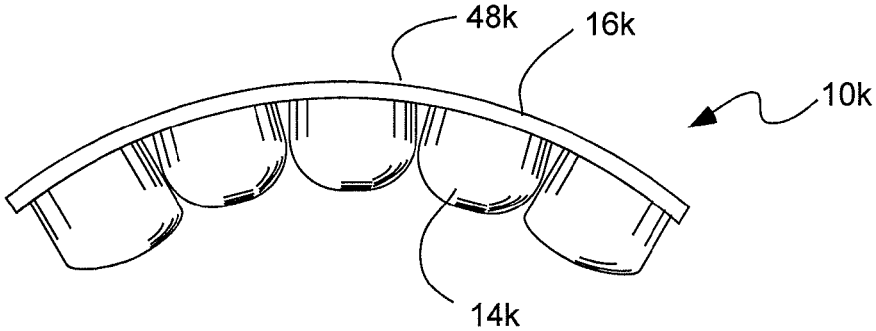
FIG. 18*b* is a side view of the soap bar of FIG. 18*a*, shown in an arc configuration with the plurality of soap bodies disposed in an arc.

Referring to FIGS. 18*a* and 18*b*, another soap bar 10*k* is shown that is similar in many respects to those described above, and which description is incorporated herein by reference. The soap body can have soap bodies 14*k* disposed on a single side of the coupler 16*i* and/or pad 48*i*. Thus, an opposite side of the coupler 16*i* and/or pad 48*i* can be provided with a grip or high friction surface to facilitate grasping and using by a user.

Figure 19:
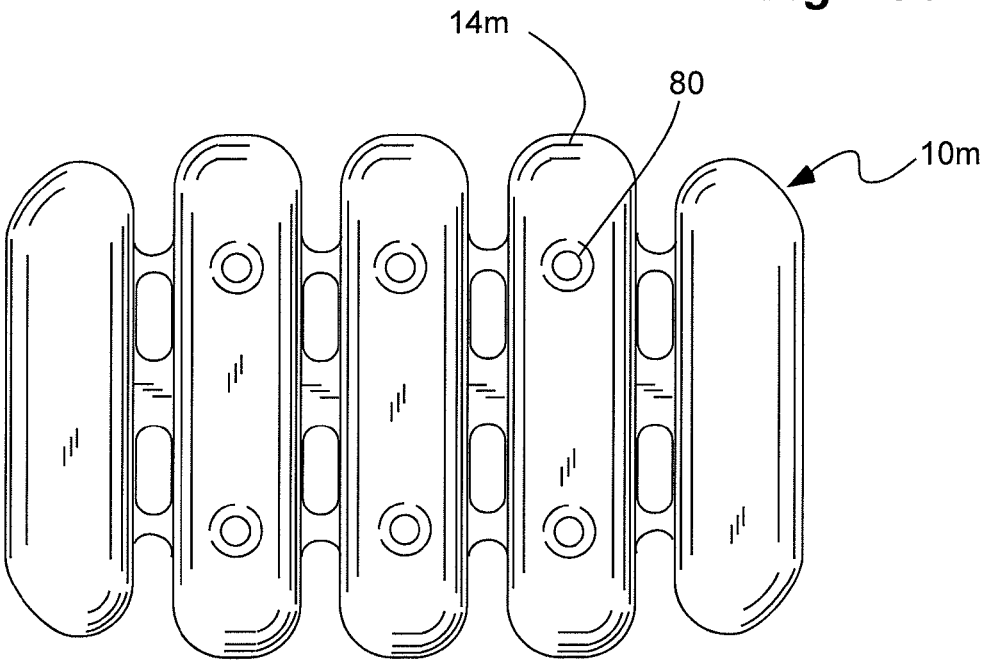
FIG. 19 is a top view of another soap bar in accordance with another embodiment of the present invention.

Referring to FIG. 19, another soap bar 10*m* is shown that is similar in many respects to those described above, and which description is incorporated herein by reference. The soap body can have soap bodies 14*m* with holes therethrough, and through the coupler and/or pad, to facilitate the flow of water.

Figure 20:
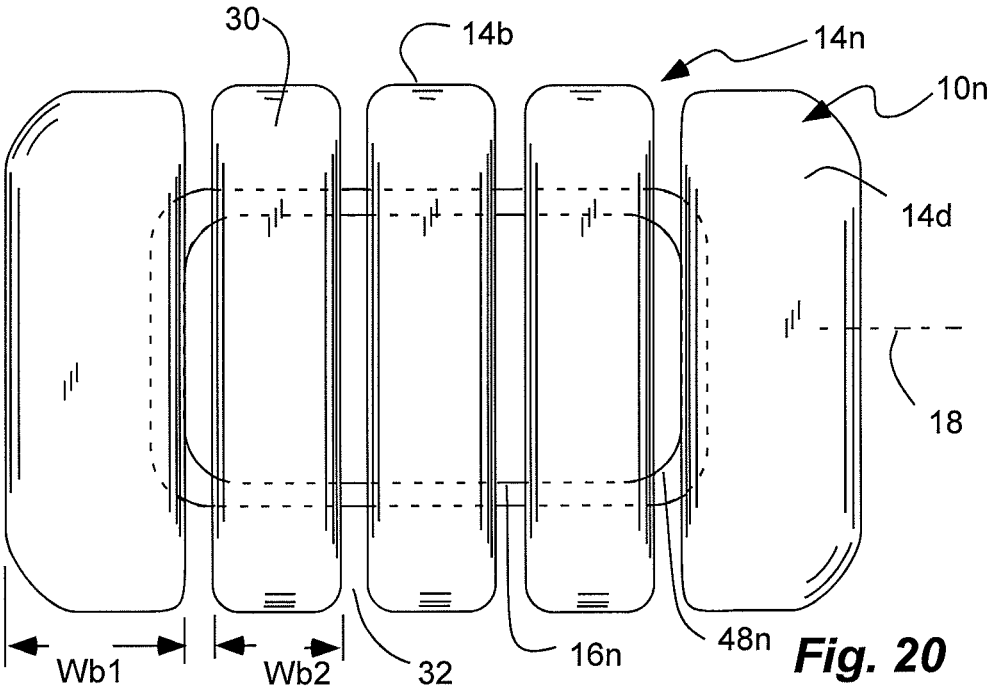
FIG. 20 is a top view of another soap bar in accordance with another embodiment of the present invention with a plurality of soap bodies.

Referring to FIG. 20, another soap bar 10*n* is shown that is similar in many respects to those described above, and which description is incorporated herein by reference. The soap body can have soap bodies 14*n* with interior soap bodies 14*b* that have adjacent soap bodies on both sides, and exterior or end soap bodies 14*d* that are disposed at the ends of the bar and have only a single adjacent soap body. In one aspect, the exterior or end soap bodies 14*d* can have a width Wb1 that is greater than the width Wb2 of the interior soap bodies 14*c*. In another aspect, the width Wb1 of the exterior or end soap bodies 14*d* can be twice as wide as the width Wb2 of the interior soap bodies 14*c*. It is believed that the wider width of the exterior soap bodies can result in more even size reduction as the soap bodies dissolve, and/or result in the soap bar 10*n* lasting as long as possible before the coupler 16*n* or pad 48*n* is exposed due to the soap bodies dissolving. In addition, the coupler 16*n* and/or pad 48*n* can form a loop to reduce the amount of material available to protrude through the soap bodies as the soap bodies dissolve during use. Furthermore, the ends of the coupler 16*n* and/or pad 48*n* can be imbedded in the exterior soap bodies 14*d* adjacent, abutting, and/or flush with an interior side thereof in order to resist the coupler or pad from protruding from the exterior soap bodies as they dissolve during use.

As described above, the shape and size (thickness, edge taper, depth, height, etc.) of the soap bodies or sections can differ from section to section, or between interior and exterior bodies, to control or synchronize the dissolving of the bodies, and extend the useful life of the soap bar. In addition, the shape and size (thickness, depth, etc.) and material of the coupler, pad or hinge can be configured to reduce the protrusion thereof from the soap bodies or section, and extend the useful life of the soap bar. The coupler, pad or hinge can have rounded corners to resist scratching of the skin if a portion of such protrudes through the soap bodes as they dissolve. In addition, the coupler, pad or hinge can be formed of a soft and/or pliant and/or flexible material to further resist scratching.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A soap device configured for personal cleansing, comprising:

a) an elongated segmented soap bar segmented longitudinally into a plurality of soap bodies separate and discrete from one another;

b) adjacent soap bodies being movable with respect to one another between at least two different configurations including an arc configuration with the plurality of soap bodies disposed in an arc, and a straight configuration with the plurality of soap bodies disposed in a substantially a straight line;

c) at least one coupler coupling the plurality of soap bodies together to allow the adjacent soap bodies to move with respect to one another between the at least two different configurations;

d) the at least one coupler comprising an elongated pad extending through the plurality of soap bodies and through a plurality of gaps between the plurality of soap bodies;

e) the elongated pad being single, unitary, continuous and monolithic;

f) the pad has embedded segments embedded in the plurality of soap bodies and exposed segments between adjacent soap bodies in the gaps; and wherein the embedded segments comprise protrusions extending into a respective soap body, or indentations recessed into the pad with the respective soap body extending therein, or both and (g) wherein the elongated pad is flexible to allow the plurality of soap bodies to move with respect to one another, and the elongated pad is elastic to return to the straight configuration.

2. A device in accordance with claim 1, wherein each of the plurality of soap bodies comprises lateral sides that taper from a wider inner portion adjacent the coupler to a narrower outer surface; and wherein the outer surfaces of the plurality of soap bodies together form a concave arc surface in the arc configuration.

3. A device in accordance with claim 1, wherein the plurality of soap bodies are spaced-apart less than a width of one of the plurality of soap bodies, with a width of a plurality of gaps between the plurality of soap bodies less than the width of one of the plurality of soap bodies.

4. A device in accordance with claim 1, wherein the at least one coupler further comprises:

a hinged connection between the adjacent soap bodies to allow the adjacent soap bodies to pivot with respect to one another.

5. A device in accordance with claim 4, wherein the hinged connection comprises a solid material forming a living hinge.

6. A device in accordance with claim 5, wherein the hinged connection has a reduced cross-sectional area with respect to an embedded segment to form the living hinge.

7. A device in accordance with claim 1, wherein each of the plurality of soap bodies has a transverse length perpendicular to a longitude of the soap bar and greater than a longitudinal width of each of the plurality of soap bodies parallel to the longitude of the soap bar; and wherein the coupler between adjacent soap bodies has a transverse length perpendicular to the longitude of the soap device greater than the longitudinal width of adjacent soap bodies.

8. A device in accordance with claim 1, wherein each of the plurality of soap bodies is separated only and solely from an adjacent soap body by a gap.

9. A device in accordance with claim 1, further comprising a plurality of gaps each disposed between a different pair of adjacent soap bodies of the plurality of soap bodies to form a series of alternating soap bodies and gaps; and wherein each of the plurality of gaps is annular and circumscribes the at least one coupler.

10. A device in accordance with claim 1, wherein the soap bodies are spaced-apart in a linear orientation and wherein adjacent soap bodies abut to one another in the arc configuration.

11. A soap device configured for personal body cleansing, the device comprising:

a) a plurality of solid soap bodies spaced-apart in an array;

b) a plurality of gaps each disposed between a different pair of adjacent soap bodies of the plurality of soap bodies to form a series of alternating soap bodies and gaps;

c) a plurality of links pivotally and removably coupled together, and each having a central embedded segment embedded in a soap body, and opposite ends with exposed segments exposed with respect to the soap body, the plurality of links coupling the plurality of soap bodies together to allow the adjacent soap bodies to move with respect to one another between at least two different configurations including: an arc configuration with the plurality of soap bodies disposed in an arc, and a straight configuration with the plurality of soap bodies disposed in a straight line;

d) each of the plurality of links comprising an axel on one end and a recess on an opposite end, with each axel removably received in an adjacent recess of an adjacent link;

e) each of the plurality of soap bodies comprises lateral sides that taper from a wider inner portion adjacent the coupler to a narrower outer surface;

f) the outer surfaces of the plurality of soap bodies together form a concave arc surface in the arc configuration; and g) the plurality of soap bodies are spaced-apart less than a width of the plurality of soap bodies, with a width of the plurality of gaps between the plurality of soap bodies less than the width of the soap bodies.

12. A device in accordance with claim 11, wherein the embedded segments comprise protrusions extending into a respective soap body, or indentations recessed into the pad with the respective soap body extending therein, or both.

13. A device in accordance with claim 11, wherein each of the plurality of soap bodies has a transverse length perpendicular to a longitude of the soap device and greater than a longitudinal width of each of the plurality of soap bodies parallel to the longitude of the soap device.

14. A device in accordance with claim 11, wherein each of the plurality of soap bodies is separated only and solely from an adjacent soap body by a gap.

15. A device in accordance with claim 11, wherein the soap bodies are spaced-apart in a linear orientation and wherein adjacent soap bodies abut to one another in the arc configuration.

16. A soap device configured for personal body cleansing, the device comprising:

a) a plurality of solid soap bodies spaced-apart in an array;

b) a plurality of gaps each disposed between a different pair of adjacent soap bodies of the plurality of soap bodies to form a series of alternating soap bodies and gaps;

c) the plurality of soap bodies are spaced-apart less than a width of one of the plurality of soap bodies, with a width of the plurality of gaps between the plurality of soap bodies less than the width of one of the plurality of soap bodies;

d) each of the plurality of soap bodies has a transverse length perpendicular to a longitude of the soap device and greater than a longitudinal width of each of the plurality of soap bodies parallel to the longitude of the soap device;

e) an elongated flexible pad extending through the plurality of soap bodies and through the plurality of gaps and forming a plurality of hinges each pivotally coupling a different pair of adjacent soap bodies, the adjacent soap bodies being pivotal with respect to one another about a respective hinge with the plurality of soap bodies being pivotal between a plurality of different configurations including: an arc configuration with the plurality of soap bodies disposed in an arc, and a straight configuration with the plurality of soap bodies disposed in a straight line;

f) the elongated pad being flexible to allow the plurality of soap bodies to move with respect to one another, and the elongated pad being elastic to return to the straight configuration;

g) the pad has embedded segments embedded in the plurality of soap bodies and exposed segments between adjacent soap bodies in the gaps, and wherein the embedded segments comprise protrusions extending into a respective soap body, or indentations recessed into the pad with the respective soap body extending therein, or both;

h) the plurality of hinges has a transverse length perpendicular to the longitude of the soap bar greater than the longitudinal width of adjacent soap bodies;

i) each of the plurality of soap bodies is separated only and solely from an adjacent soap body by a gap;

j) each of the plurality of soap bodies comprises lateral sides that taper from a wider inner portion adjacent the pad to a narrower outer surface;

k) the outer surfaces of the plurality of soap bodies together form a concave arc surface in the arc configuration; and l) the soap bodies are spaced-apart in the straight configuration, and adjacent soap bodies abut to one another in the arc configuration.

17. A device in accordance with claim 16, wherein the elongated pad is single, unitary, continuous and monolithic.

* * * * *